US005863147A

United States Patent [19]

Pressler

[11] Patent Number: 5,863,147

[45] **Date of Patent: *Jan. 26, 1999**

[54] PAVEMENT FOR CONVEYING VEHICULAR TRAFFIC

[75] Inventor: David E. Pressler, 58788 State Rd. 15 N., Box 302, Goshen, Ind. 46526

[73] Assignees: David E. Pressler; Stephen J. Schneider, both of Goshen, Ind.

[ * ] Notice: This patent issued on a continued prosecution application filed under 37 CFR 1.53(d), and is subject to the twenty year patent term provisions of 35 U.S.C. 154(a)(2).

[21] Appl. No.: 647,559

[22] Filed: May 14, 1996

[51] Int. Cl.[6] ..... F01C 3/00

[52] U.S. Cl. ..... 404/17; 404/27; 238/2; 238/5

[58] Field of Search ..... 404/17, 27, 28, 404/36, 2, 31; 14/73, 74.5, 77.1, 75; 238/2, 3, 5, 6, 7, 9; 52/169.9, 174, 294, 295, 741.15; 405/229

[56] References Cited

U.S. PATENT DOCUMENTS

| | | | |
|---|---|---|---|
| 1,281,833 | 10/1918 | Quinlin | 238/5 |
| 1,313,000 | 8/1919 | Maxim | 238/5 |
| 2,228,763 | 1/1941 | Henderson | 52/294 |
| 3,272,096 | 9/1966 | Lum | 52/174 |
| 3,587,964 | 6/1971 | Cork | 238/2 X |
| 3,910,710 | 10/1975 | Gagle et al. | 404/31 X |
| 4,105,353 | 8/1978 | Bork et al. | 404/2 |
| 4,376,595 | 3/1983 | Shaw | 404/17 |
| 4,406,403 | 9/1983 | Luebke | 238/2 |
| 5,026,207 | 6/1991 | Heath | 405/229 X |

FOREIGN PATENT DOCUMENTS

| | | | |
|---|---|---|---|
| 554796 | 1/1957 | Italy | 52/294 |
| WO 88/09412 | 12/1988 | WIPO | 404/31 |

*Primary Examiner*—James A. Lisehora
*Attorney, Agent, or Firm*—Baker & Daniels

[57] ABSTRACT

A rigid concrete slab for conveying vehicular or railroad traffic which is provided with functional longitudinal beams that extend or protrude downward from the underside of the slab and are fully and continuously supported by the underlying material. The attached beams enhance, strengthen and stabilize both longitudinally and transversely. Friction and suction, or interface adhesion, between the beams and the underlying material in which it rests causes the beams to act as anchors thereby further resisting displacement or distortion of the slab.

10 Claims, 7 Drawing Sheets

PAVEMENT FOR CONVEYING VEHICULAR TRAFFIC

This invention relates to pavement for conveying vehicular traffic, including both highway and railroad traffic.

When a portland cement concrete or other rigid slab on grade is exposed to the stresses of vehicular traffic axle loadings or thermal expansion and contraction stresses, the relatively thin slab deforms to accommodate these stresses. When the slab deforms, cracks may form in the slab which further weaken the slab and allow water and other undesirable materials to enter the slab structure. This process, when extended over a variable number of repetitive cycles, will eventually cause the serviceability of the slab to deteriorate until the slab reaches a point of total failure.

Because typical slabs are relatively thin in the vertical dimension they have little inherent ability to resist vertical deformations. The slab integrity relies upon the stability of the underlying roadbed materials or the strength of the concrete slab, and the reinforcing materials incorporated in the slab, to resist the deformations and the resultant cracking. The Moment of Inertia about the horizontal axis of the relatively thin slab is usually insufficient to stop the deformations from taking place.

Consequently, axle loadings which approach the maximum design loadings for the slab may produce visible or invisible deflections in the slab. This deflection process produces a pumping effect under the slab which can draw water and other undesirable materials into cavities which are created under the slab. Subsequent axle loadings will discharge the water and other small waterborne particles through cracks in the slab from these cavities when the slab deflects downward and compresses the water. This pumping action eventually enlarges the underlying cavities until the support for the slab is sufficiently decreased or degredated to a point where the slab fails.

Slabs also deflect due to unrestrained thermal stresses within the slab. Typically, the top of a slab is exposed to the atmosphere and sunlight which usually causes it to expand during the day and contract at night. The bottom side of the slab changes temperature at a much slower rate due to the constant exposure to the surrounding soil mass which acts as an insulator. Consequently, the center of the slab rises in relation to the slab edges when the top of the slab is warmer than the bottom, and conversely, the unrestrained slab edges rise in relation to the slab center when the bottom of the slab is warmer than the top. This action can cause the slab to crack and eventually fail in a fashion similar to that experienced by repeated axle loadings. Whenever a slab fails the result is a surface that is uneven or cavitated. This cavitation is distressing to any vehicle which passes over the slab and contacts the uneven areas. Repairs will usually follow which are expensive and disruptive to the traffic using the slab. Previously, to avoid these problems, the overall depth of the entire slab or the underlying roadbed was increased to give the slab greater ability to resist the loads applied. Due to the large quantities of materials required to thicken the entire slab or roadbed this construction is usually very expensive.

This invention comprises a subterranean concrete beam (or beams) usually oriented in a parallel and longitudinal fashion (or oriented in various other fashions which may be advantageous to the designer or end user) which is integrally attached to, or integrated into, the bottom of a concrete slab which carries vehicular traffic. This beam can be of various sizes, shapes and spacings under the slab to allow the design loads to be properly supported. The slab and the beam act as an integral unit and may contain varying amounts of reinforcing materials to accommodate stresses that cannot be handled by the concrete alone. One purpose of adding the beams under the slab is to greatly increase the load carrying capabilities of the slab using a minimum of materials so heavier axle loadings can use the slab for an increased period of time before the slab requires maintenance or replacement. Another purpose of this invention is that the beams act as an anchor which resists the deflections in the slab usually caused by thermally or axle load induced stresses in the slab. The slab does not deflect as much which greatly reduces the number and severity of the cracks in the slab. This, in turn, keeps water and other deleterious materials from entering the slab structure which prolongs the life of the slab. The beams also provide added strength because of the greatly increased Moment of Inertia about the horizontal axis of the slab. Because the beams are buried below grade they also act as an anchor to keep the slab from flexing due to thermally induced stresses. The invention is particularly advantageous when the load is to be supported is substantial and dynamic in nature.

These and other advantages of the present invention will become apparent from the following description, with reference to the accompanying drawings, in which.

Figure 1:
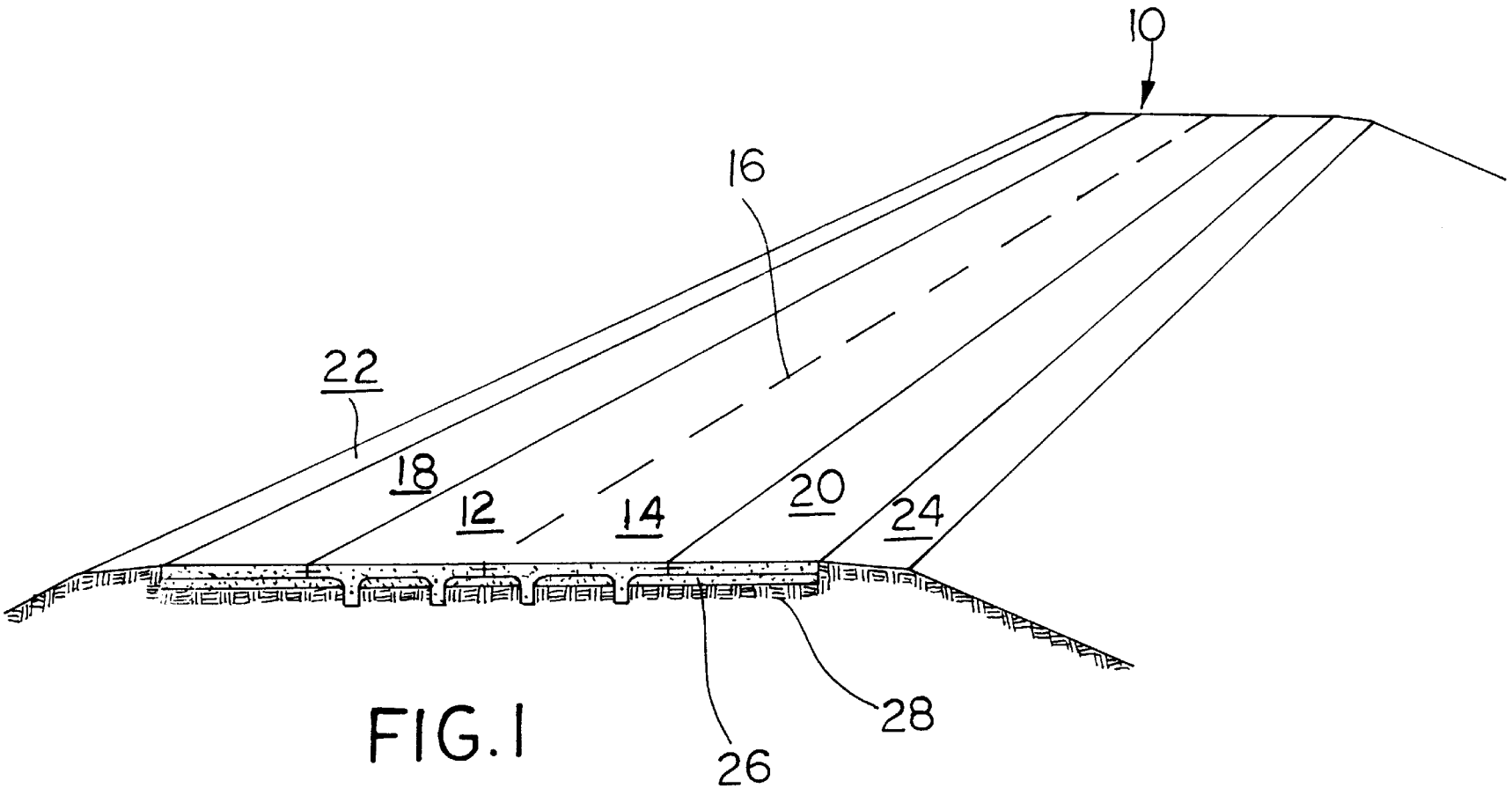
FIG. 1 is a perspective view, partly in section, of a highway pavement made pursuant to the teachings of the present invention.

Referring now to the drawings, a two lane highway pavement generally indicated by the numeral 10 includes a pair of slabs 12 and 14 joined together along center line 16. The slabs 12 and 14 define the traffic lanes of a two lane highway. A pair of paved concrete shoulders 18, 20 extend outwardly from each of the slabs 12 and 14, and earthen berm 22, 24 extend outwardly from the paved shoulders 18 and 20. The slabs 12 and 14 and shoulders 18 and 20 are supported by a granular, asphalt or another commonly used subbase material 26, such as gravel, to facilitate drainage of moisture away from pavement 10. The subbase material is supported directly on the earthen subgrade generally indicated by the numeral 28 which has been leveled and compacted. Hereinafter, the subbase 26 and subgrade 28 are collectively referred to the "subslab" material. Conventional reinforcing steel 30 is laid in the slabs 12, 14 of pavement 10 in the conventional manner.

According to the invention, a pair of longitudinally extending, transversely spaced beams 32, 34 extend downwardly from each of the slabs 12, 14 defining the traffic lanes of the pavement 10. The beams 32, 34 are tied to their corresponding slabs 12 or 14 by conventional tie bars 36. The beams 32 and 34 (or a single beam) extend through the subbase material 26 and into trenches 40, 42 in the subgrade material 28. Preferably, the beams 32, 34 are made of concrete poured directly into the trenches 40 and 42 such that the beams completely fill the trenches. Each of the beams 32, 34 include a pair of side edges 44, 46 and a lower connecting edge 48. It will be noted that the side edges 44 of the beam 34 faces side edge 46 of the beam 32 so that the beams 32, 34 retain the portion of the subbase material 26*a* between the beams 32 and 34 to prevent that portion 26*a* of the subbase material 26 from being washed away. It will also be noted that each of the beams 32 and 34 are engaged by, and supported by the subslab material 26 and 28 on all three projecting sides of the beams 32 and 34.

The beams 32 and 34 resist deformation of the corresponding slab 12 and 14 in the both the longitudinal and transverse direction. Temperature changes cause thermal stresses in the slabs both transversely and longitudinally. The presence of the beams stiffens the slab in the longitudinal direction, thereby permitting the slab to better resist longitudinal deformation of the slab. In addition to longitudinal deformation due to changes in temperature, axle loadings, particularly those of heavy trucks, can also deform the slab in the longitudinal direction. The beams 32, 34 are placed under the slab in a position which bears most of the weight of the traffic on the slab, thereby reinforcing that portion of the pavement which bears the axle loadings, thereby permitting the pavement to withstand heavier axle loadings for a longer period of time than prior art pavements. Accordingly, side edge portions of the slab 50, 52 are defined between the corresponding beams 32, 34 and the corresponding side edges 54, 56 of the slab. Deformation of the side edge portions 50, 52 may or may not be resisted by tieing the edge portions to either the adjacent slab or to a corresponding concrete shoulder by use of tie bars 58.

Figure 6:
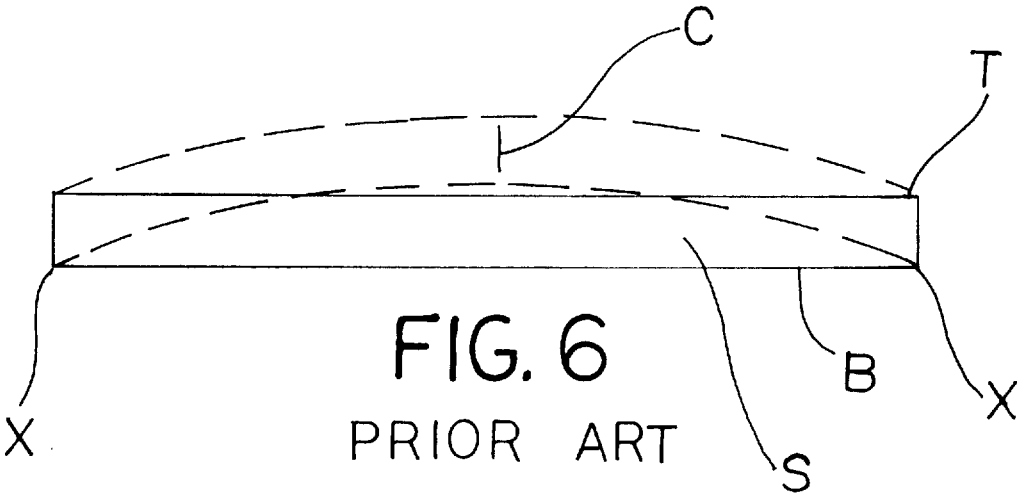
FIG. 6 PRIOR ART
FIGS. 6 and 7 are diagrammatic illustrations of the response of prior art pavement when exposed to heat and cold ambient conditions.
Figure 7:
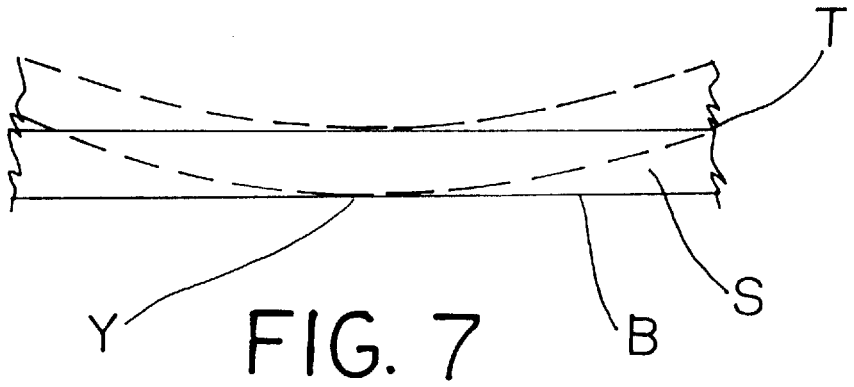
FIG. 7 PRIOR ART

Temperature changes may cause transverse deformations in the slab. For example, in FIGS. 6 and 7, the nominal position of a slab is illustrated in solid lines. In FIG. 6, in warm weather, the top surface T of the slab is warmed by the sun and expands. The bottom surface B of the slab remains against the relatively cold ground or subslab material and either does not expand or expands to a lesser amount. Accordingly, the slab assumes the position indicated by the dashed lines in FIG. 6. Of course, the amount of deformation is exaggerated. Nevertheless, the slab tends to be supported at the points X at the edges of the slab, and the middle portion of the slab tends to be unsupported. Some suction is created tending to draw the middle portion back towards the ground, but since concrete is relatively weak in tension, cracks C can occur almost immediately, tending to cause break up and failure of the slab. Referring to FIG. 7, in cold weather, the top of the slab curls upwardly, causing the slab to assume the shape indicated by the dotted lines in FIG. 7. Again, the degree of deformation has been exaggerated. Nevertheless, the slab is supported at the point Y, and the edges of the slab remain relatively unsupported. Accordingly, traffic tends to push down the edges of the slab, causing breakup of the slab and ultimate failure. With the present invention, the beams 32, 34, made of concrete or similar rigid material, act as anchors as well as thermal heat sinks, thereby tending to resist deformation illustrated in FIGS. 6 and 7. These deformations are also resisted because the side edges 44, 46 and 48 of the beams 32 and 34 are frictionally engaged with the edges of their corresponding trenches 40 and 42. Furthermore, a negative air pressure, creating a suction, may occur between the beams and the lower edge of the trench which further resists movement of the slab. Although the suction will vary depending on the type of soil, the moisture of the soil, etc., it will nonetheless be substantial. Accordingly, the friction acting on the edges of the beam further resists deformation of the pavement of the type known in the prior art and illustrated in FIGS. 6 and 7. The beams therefore act as anchors for the slab, and assist the slab in resisting the pumping action discussed above. The width of the beams 32, 34 and the distance in which they penetrate into the subslab material, may be adjusted to maximize this friction and suction depending upon the traffic conditions expected, and the type of soil and the average moisture content of the soil. In the prior art, the only way to resist the longitudinal and transverse distortions of the slab discussed above is to increase the thickness of the slab. By providing the beams 32 and 34, the thickness of the slab may be reduced while still resisting the aforementioned deformations. Furthermore, the beams 32 and 34 can be made of a porous material, such as porous concrete, in a manner well known to those skilled in the art. Porous concrete permits moisture to drain from the subbase material 26 through the beams 32 and 34 into longitudinally extending conduits 60 which are placed in the beams 32, 34 near their lower edges 48 thereof. Accordingly, water and other moisture may be carried away through the conduits 60, which may be, for example, pipe.

Figure 2:
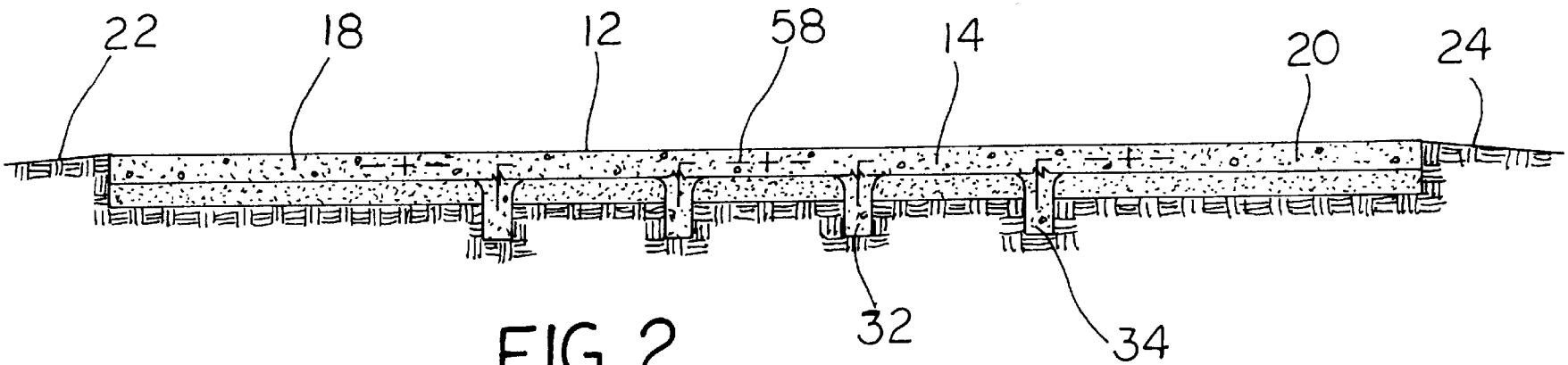
FIG. 2 is an enlarged, transverse, cross-sectional view of the highway pavement illustrated in FIG. 1.
Figure 3:
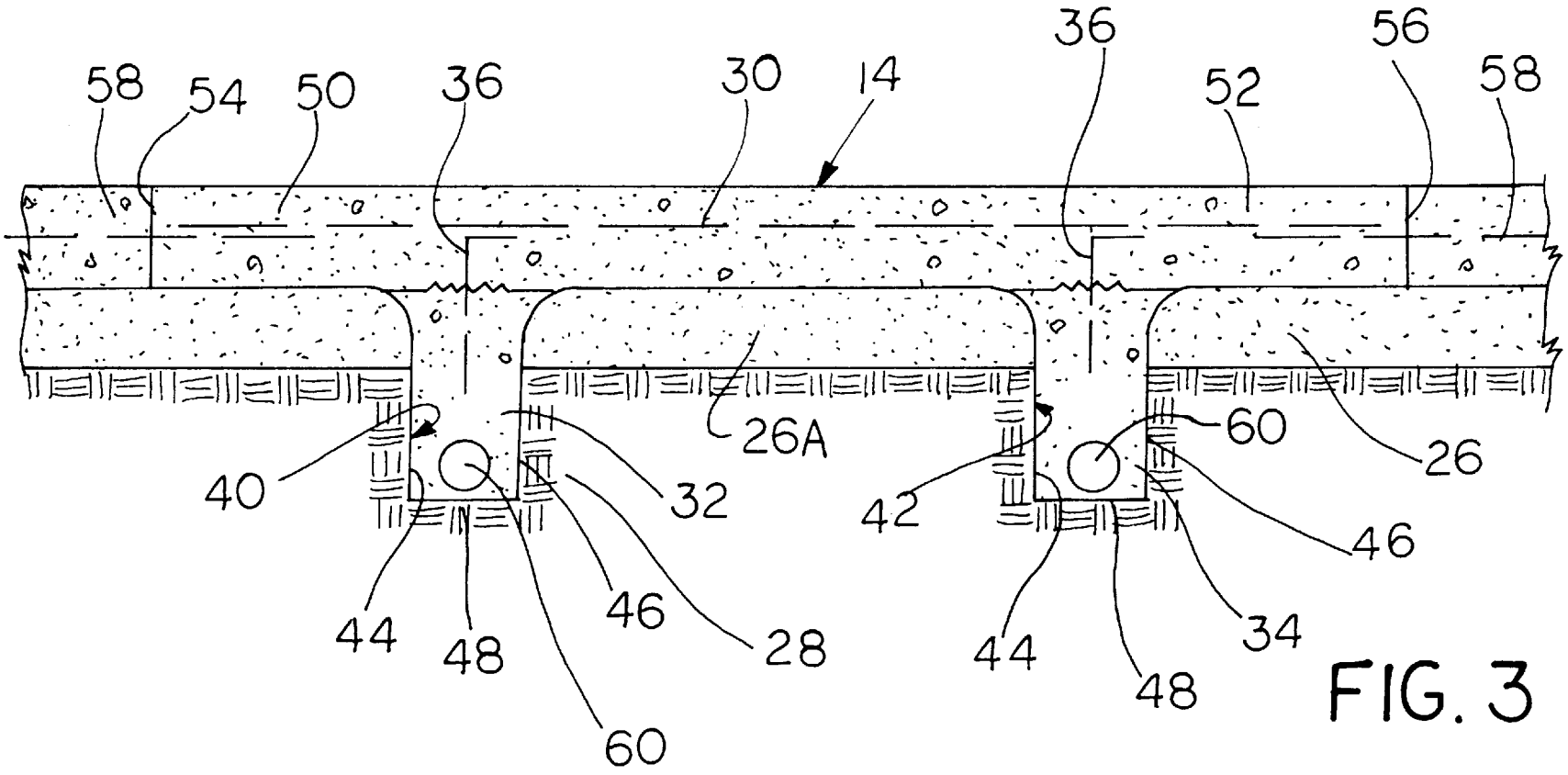
FIG. 3 is a fragmentary, transverse, cross-sectional view of a portion of the pavement illustrated in FIGS. 1 and 2.
Figure 4:
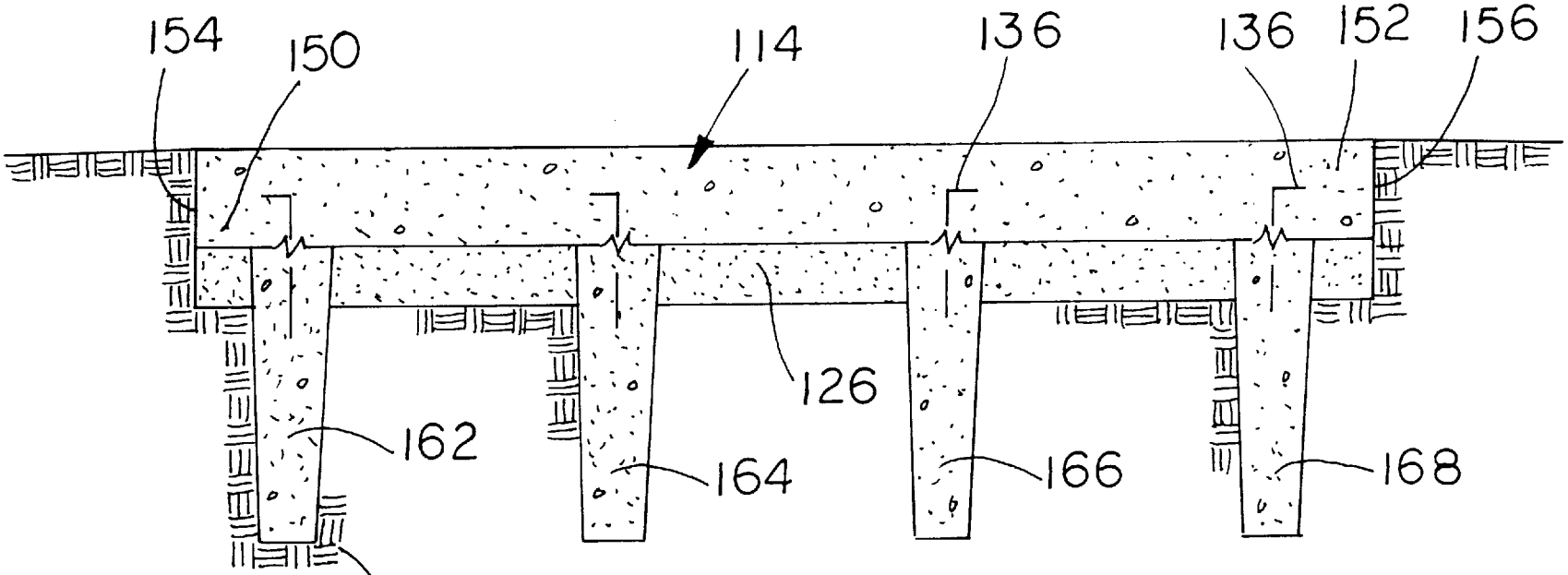
FIG. 4 is a view similar to FIG. 3 but illustrating an alternate embodiment of the present invention.

Referring now to FIG. 4, elements the same or substantially the same as those in the embodiment of FIGS. 1–3 retain the same reference characters, but increased by 100. In the embodiment in FIG. 4, the slab 114 is supported by four substantially parallel, longitudinally extending beams 162, 164, 166, and 168. Accordingly, the number of beams supporting the slab in the present invention can be varied to carry heavier axle loads, to resist thermal loads, and to minimize the quantity of paving and subbase material required. For example, if four beams are used, each beam may be narrower than in the case when fewer beams are being used, since the span between the beams are smaller, the thickness of the slab may be similarly reduced. The number of beams may be optimized depending upon soil conditions, expected traffic loads, thermal conditions, etc. It will also be noted that the beams 162 and 168 are relatively close to the edges 154 and 156, thereby permitting the side edge portions 150, 152 to be supported by the beams instead of being tied into paved shoulders for their support.

Figure 5:
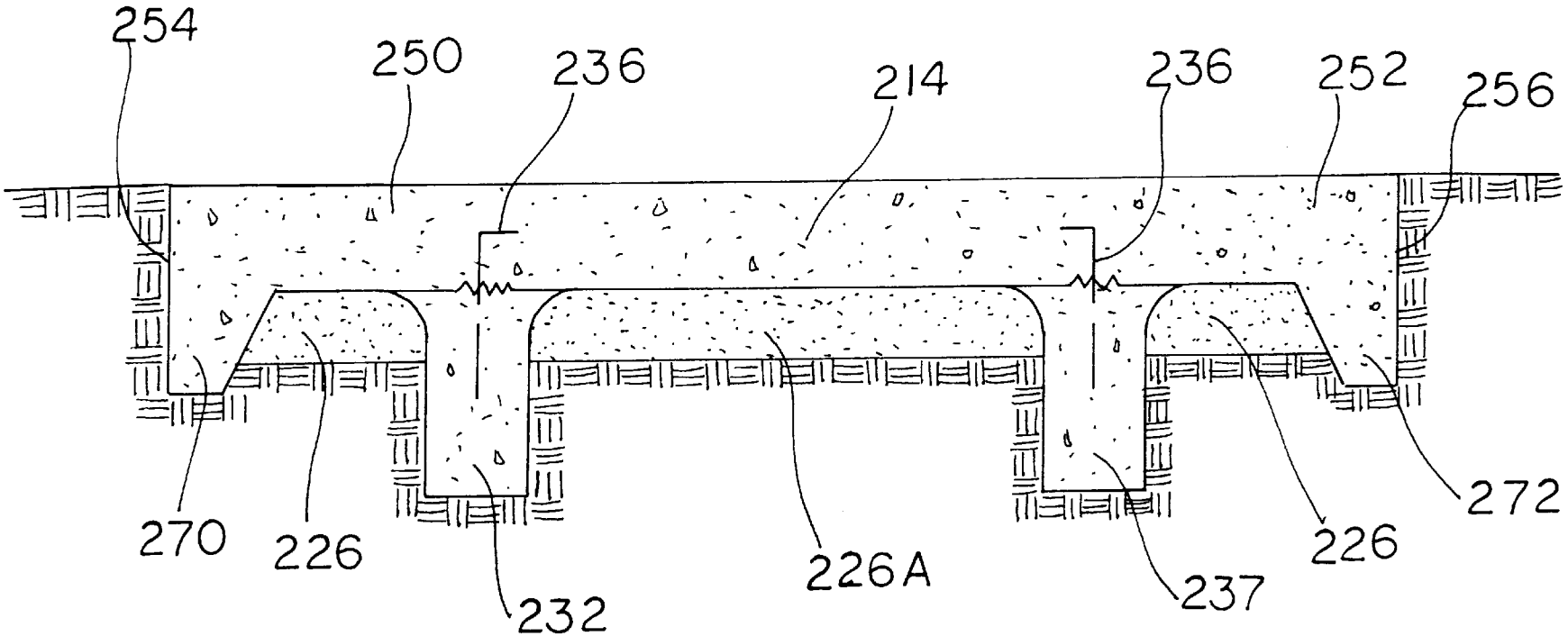
FIG. 5 is a view similar to FIGS. 3 and 4 but illustrating another alternate embodiment of the present invention.

In the embodiment in FIG. 5, elements the same or substantially the same as those in embodiment in FIG. 1–3 retain the same reference characters, but increased by 200. Referring to FIG. 5, the side edge portion 250, 252 of slab 214 as supported by subrails 270, 272 which project downwardly along edges 254, 256 and thus stabilize and support the edge portions 250, 252 of the slab 214. The embodiment of FIG. 5 is particularly useful when there are no concrete shoulder to tie to the edge portions 250, 252.

Figure 8:
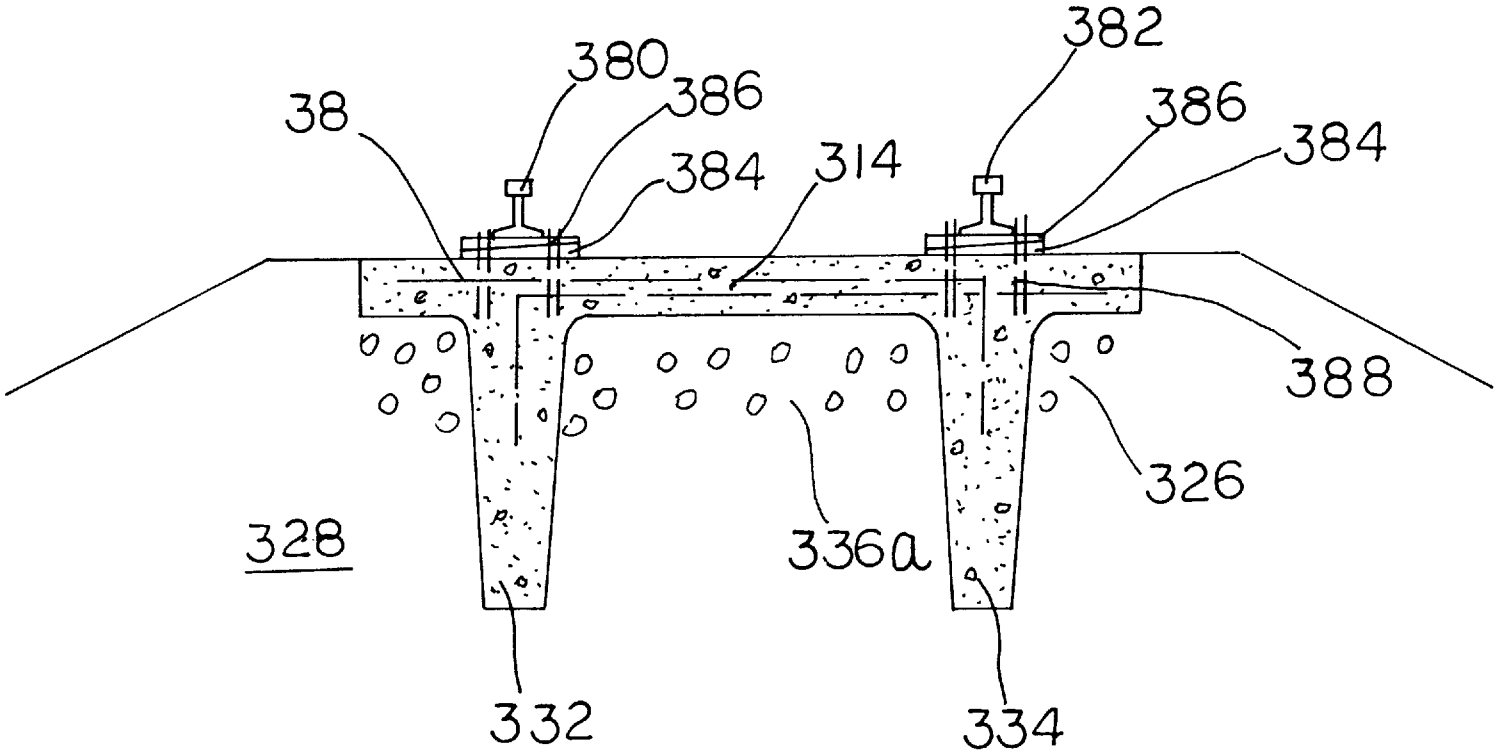
FIG. 8 is a transverse, cross-sectional view taken through a pavement designed for carrying railroad traffic.

Referring now to FIG. 8, elements the same or substantially the same as those in the embodiment in FIGS. 1–3 retain the same reference character, but increased by 300. The embodiment of FIG. 8 discloses the present invention applied to a railroad roadbed. The slab 314 supports conventional railroad rails 380, 382 which can be secured thereto by base and shim plates 384, 386 and anchor bolts 388. Since the weight of traffic is applied to the slab 314 at the rails 380, 382, the beams 332, 334 can be situated directly below the rails 380, 382, so that the strength of the slab 314 is maximized and the deflection of the slab will be minimized. The rails 380, 382 are often subjected to large stresses both due to the application of the railroad traffic on the rails and because of thermal changes. Conventional practice is to restrain the rails so that they take these stresses by the use of wooden cross ties, which are mounted in stone ballast. The railroad ties and rails require a great deal of maintenance, since the ties must be replaced on a fairly regular basis. The use of the concrete slab 314, which is stabilized by the beams 332 and 334 as discussed above allows the application of heavier axle loadings and increases the overall life of the structure.

I claim:

1. Pavement for conveying vehicular traffic or loads comprised of a rigid, longitudinally extending concrete slab, subslab material continuously supporting said slab and including a granular subslab material in continuous contact with said slab and an earthen subslab material below the granular subslab material, and a pair of parallel, downwardly protruding, longitudinally extending concrete slab anchor beams structurally integrated with said slab and extending therefrom through said granular subslab material and into said earthen subslab material, said granular and earthen subslab material extending continuously between said slab anchor beams, said subslab material being in continuous contact with the slab anchor beams along the longitudinal length thereof, said slab anchor beams extending into the earthen subslab material to a depth adequate to develop sufficient frictional forces between the earthen subslab material and said slab anchor beams sufficient to restrain flexing and movement of the slab in the longitudinal, transverse and in both upward and downward vertical directions caused by thermal gradients within the slab whereby cavities between the slab and the granular subslab material and resulting deterioration of the slab are avoided.

2. Pavement as claimed in claim 1, wherein said slab anchor beams fill corresponding longitudinal trenches in said subslab material, said trenches extending through the granular subslab material and into the earthen subslab material.

3. Pavement as claimed in claim 1, wherein said slab defines a pair of longitudinally extending side edges, each of said slab anchor beams being offset transversely from a corresponding one of said side edges.

4. Pavement as claimed in claim 1, wherein rails for supporting railroad traffic are mounted on said slab.

5. Pavement as claimed in claim 1, wherein said slab is structurally integrated with four of said parallel slab anchor beams.

6. Pavement for conveying vehicular traffic or loads, comprised of a rigid longitudinally extending concrete slab having a top side and a bottom side, subslab material including earthen subslab material underlying said slab, and a pair of parallel, downwardly protruding, longitudinally extending concrete slab anchor beams structurally integrated with said slab and having outer surfaces, said slab extending continuously between said slab anchor beams, said subslab material being in continuous contact with all outer surfaces of said slab anchor beams and the bottom side of the slab along the longitudinal length thereof, said slab anchor beams extending from the slab into the underlying subslab material and filling trenches formed in said earthen subslab material, said slab anchor beams extending into said earthen subslab material to a depth adequate to develop sufficient frictional forces between the subslab material and said slab anchor beams to restrain flexing and movement of the said slab in the longitudinal, transverse and in both upward and downward vertical directions caused by thermal gradients within said slab, whereby cavities between the slab and the subslab material, and resulting deterioration of the slab, are avoided.

7. Pavement as claimed in claim 6, wherein said slab is substantially integrated with four of said parallel slab anchor beams.

8. Pavement as claimed in claim 6, wherein said slab defines a pair of longitudinally extending side edges, corresponding slab anchor beams being offset transversely from a corresponding one of said side edges to define an edge portion of said slab between each of said corresponding slab anchor beams and their corresponding side edge.

9. Method of constructing pavement for conveying vehicular traffic in a longitudinal direction comprising the steps of digging substantially parallel trenches extending in said longitudinal direction and downwardly into subslab material, filling the trenches with concrete thereby forming longitudinally extending, continuous, substantially homogeneous anchor beams, laying a slab of concrete extending continuously between said anchor beams and structurally integrated with the anchor beams and in continuous contact with the subslab material, said slab anchor beams and said trenches extending into the subslab material to a depth adequate to develop sufficient frictional forces between the subslab material and the slab anchor beams sufficient to restrain flexing and movement of the slab in the longitudinal, transverse, and in both upward and downward vertical directions caused by thermal gradients within said slab whereby cavities between the slab and the subslab material and resulting deterioration of the slab are avoided.

10. Method claimed in claim 9, including the steps of digging four substantially parallel trenches, filling said four trenches with concrete and structurally integrated said slab over all four of said anchor beams.

* * * * *